US008851617B1

(12) United States Patent
Sjoberg et al.

(10) Patent No.: US 8,851,617 B1
(45) Date of Patent: Oct. 7, 2014

(54) PROVIDE PRINTING FLUID TO PRINTHEAD

(71) Applicant: Hewlett-Packard Development Company L. P., Houston, TX (US)

(72) Inventors: Erik Kristofer Sjoberg, Singapore (SG); Jason M Quintana, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/849,890

(22) Filed: Mar. 25, 2013

(51) Int. Cl.
*B41J 29/393* (2006.01)

(52) U.S. Cl.
USPC ..... 347/19; 347/41

(58) Field of Classification Search
USPC ..... 347/19, 41
See application file for complete search history.

(56) References Cited

U.S. PATENT DOCUMENTS

| | | | | |
|---|---|---|---|---|
| 5,427,136 | A | 6/1995 | Weishew | |
| 6,183,054 | B1 | 2/2001 | Froger et al. | |
| 6,312,075 | B1 * | 11/2001 | Walker | 347/7 |
| 6,890,051 | B2 | 5/2005 | Otis, Jr. | |
| 6,981,754 | B2 | 1/2006 | Godil et al. | |
| 7,192,108 | B2 | 3/2007 | Lyman | |
| 7,393,078 | B2 * | 7/2008 | Yazawa et al. | 347/19 |
| 7,883,198 | B2 | 2/2011 | McCracken et al. | |
| 8,277,006 | B2 * | 10/2012 | Donahue et al. | 347/6 |
| 2009/0322806 | A1 | 12/2009 | Donahue et al. | |
| 2010/0182387 | A1 | 7/2010 | Silverbrook et al. | |
| 2012/0299989 | A1 | 11/2012 | Prothon et al. | |

OTHER PUBLICATIONS

Einat, M. et al., "Two-dimension full array high-speed ink-jet print head," Applied Physics Letters 89, Aug. 2006, 3 pages.
Wijshoff, H., "The dynamics of the piezo inkjet printhead operation," (Web page), Jun. 2010, found on pp. 77-177, vol. 491, No. 4-5 at http://www.sciencedirect.com/science/article/pii/S0370157310000827.

* cited by examiner

*Primary Examiner* — Lamson Nguyen
(74) *Attorney, Agent, or Firm* — Victor DeVito

(57) ABSTRACT

A method includes identifying a sufficient amount of printing fluid for a printhead to print a current swath and determining whether the sufficient amount of printing fluid is equal to or greater than a volume threshold value based on at least a second printing fluid volume capacity of a second region. The method also includes providing an amount of time after printing a previous swath and prior to a completion of printing the current swath for a second region to be supplied with an additional amount of printing fluid from a first region in response to a determination that the sufficient amount of printing fluid is equal to or greater than the volume threshold value.

15 Claims, 5 Drawing Sheets

PROVIDE PRINTING FLUID TO PRINTHEAD

BACKGROUND

Printing systems may include a printing fluid delivery system and a printhead. The printing fluid delivery system may provide printing fluid to the printhead to print a plurality of swaths on media to form an image thereon.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printing systems may include a printing fluid delivery system and a printhead. The printing fluid delivery system may include a printing fluid supply. The printing fluid delivery system may provide printing fluid to the printhead to print a plurality of swaths on media to form an image thereon. The printing system may print swaths on the media at a normal print speed. Periodically, however, the printing system printing at a normal print speed may result in an increase in image defects due to changes in localized flow rates in regions within the printing fluid delivery system. The changes in localized flow rates may continue throughout a life of the printing fluid delivery system, for example, due to a change in the remaining amount of printing fluid therein. Thus, at times, consistently printing at the normal print speed by the printing system may reduce image quality. Alternatively, the printing system may print images at a reduced print speed to improve image quality for a time period longer than necessary. Printing at a reduced print speed for longer than necessary, however, may reduce the throughput of the printing system.

In examples, a method to control a flow-rate of printing fluid in a printing fluid delivery system including a second region to receive the printing fluid from a first region and to provide the printing fluid to a printhead to print a plurality of swaths is disclosed. The method includes, amongst other things, identifying a sufficient amount of printing fluid for the printhead to print a current swath and determining whether the sufficient amount of printing fluid is equal to or greater than a volume threshold value based on at least a second printing fluid volume capacity of the second region. The method also includes providing an amount of time after printing a previous swath and prior to the completion of printing the current swath for the second region to be supplied with an additional amount of printing fluid from the first region in response to a determination that the sufficient amount of printing fluid is equal to or greater than the volume threshold value. Thus, the printing system may reduce image defects and/or throughput reduction.

Figure 1:
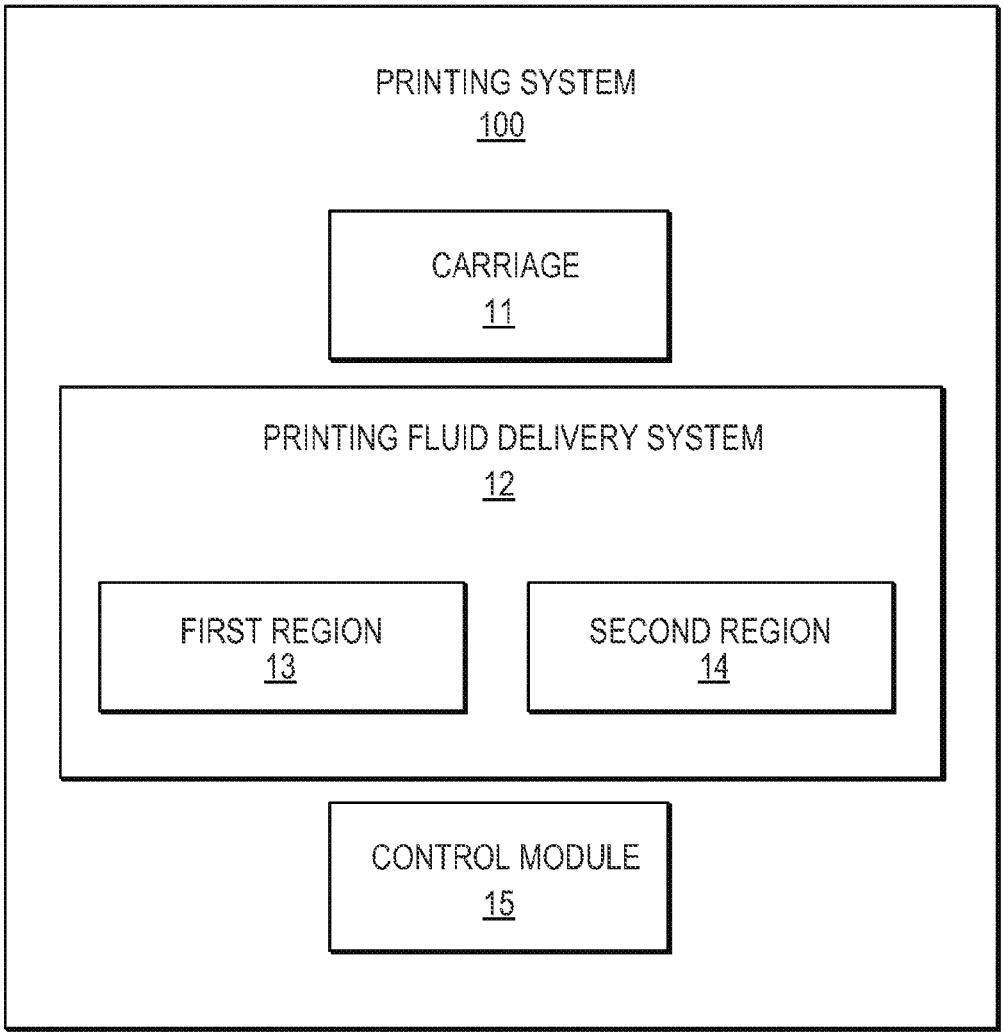
FIG. 1 is a block diagram illustrating a printing system according to an example.

FIG. 1 is a block diagram illustrating a printing system according to an example. Referring to FIG. 1, in some examples, a printing system 100 includes a carriage 11, a printing fluid delivery system 12, and a control module 15. The carriage 11 may be coupled to a printhead to move the printhead in a form of sweeps. A respective sweep may occur from completion of printing a previous swath to a completion of printing a current swath. The printhead may print an image on media in a form of swaths. The printhead, for example, may include an inkjet printhead, a plurality of printhead modules, a printbar, and/or a printhead assembly, and the like. A swath, for example, may correspond to a portion of the image printed on the media by the printhead during a single pass of the printhead over the media.

Referring to FIG. 1, in some examples, the printing fluid delivery system 12 includes a first region 13 having a first printing fluid volume capacity to store printing fluid and a second region 14 having a second printing fluid volume capacity that is less than the first printing fluid volume capacity. The second region 14 may receive the printing fluid from the first region 13 and provide the printing fluid to the printhead. The control module 15 may identify a sufficient amount of printing fluid for the printhead to print the current swath and determine whether the sufficient amount of printing fluid is equal to or greater than a volume threshold value based on at least a second printing fluid volume capacity of the second region 14. In some examples, the volume threshold value may be a number corresponding to a total of the volume of the second printing fluid volume capacity and a supplemental refill volume. The supplemental refill volume may correspond to an amount of printing fluid to be added to the second region 14 over a respective time period.

The control module 15 may identify an additional amount of printing fluid to be supplied to the second region 14 during the respective sweep in response to a determination that the sufficient amount of printing fluid is equal to or greater than the volume threshold value based on at least a second printing fluid volume capacity of the second region 14. Additionally, the control module 15 may determine an amount of time to provide the additional amount of printing fluid to the second region 14 during the respective sweep based on at least a refill rate of the second region 14 in response to the determination that the sufficient amount of printing fluid is equal to or greater than the volume threshold value. In some examples, the first region 13 and the second region 14 may be arranged in fluid communication and in series with each other. The refill rate of the second region 14 may be a rate at which printing fluid enters the second region 14. In some examples, the refill rate of the second region 14 may correspond to an extraction rate of the first region 13. The extraction rate of the first region 13 may be the rate at which printing fluid leaves the first region 13.

The control module 15 may provide the amount of time during the respective sweep for the second region 14 to be supplied with the additional amount of printing fluid from the first region 13 in response to the determination that the sufficient amount of printing fluid is equal to or greater than the volume threshold value. Alternatively, the control module 15 may allow printing of the current swath at a normal print speed in response to a determination that the sufficient amount of printing fluid for the printhead to print the current swath is less than the volume threshold value. The normal print speed, for example, may be the print speed that the printing system 200 prints on the media without an addition of a delay period determined and provided by the control module 15 to correspond to the second region 14 to be supplied with the additional amount of printing fluid from the first region 13. The delay period, for example, may include a pause of a scanning of the printhead and/or a reduction of a scanning speed of the printhead for a respective period of time during a respective sweep. The scanning speed may correspond to a speed at which the printhead moves across a print zone to print a swath on media during a respective sweep.

In some examples, the control module 15 may be implemented in hardware, software including firmware, or combinations thereof. The firmware, for example, may be stored in memory and executed by a suitable instruction-execution system. If implemented in hardware, as in an alternative example, the control module 15 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In some examples, the control module 15 may be implemented in a combination of software and data executed and stored under the control of a computing device.

Figure 2:
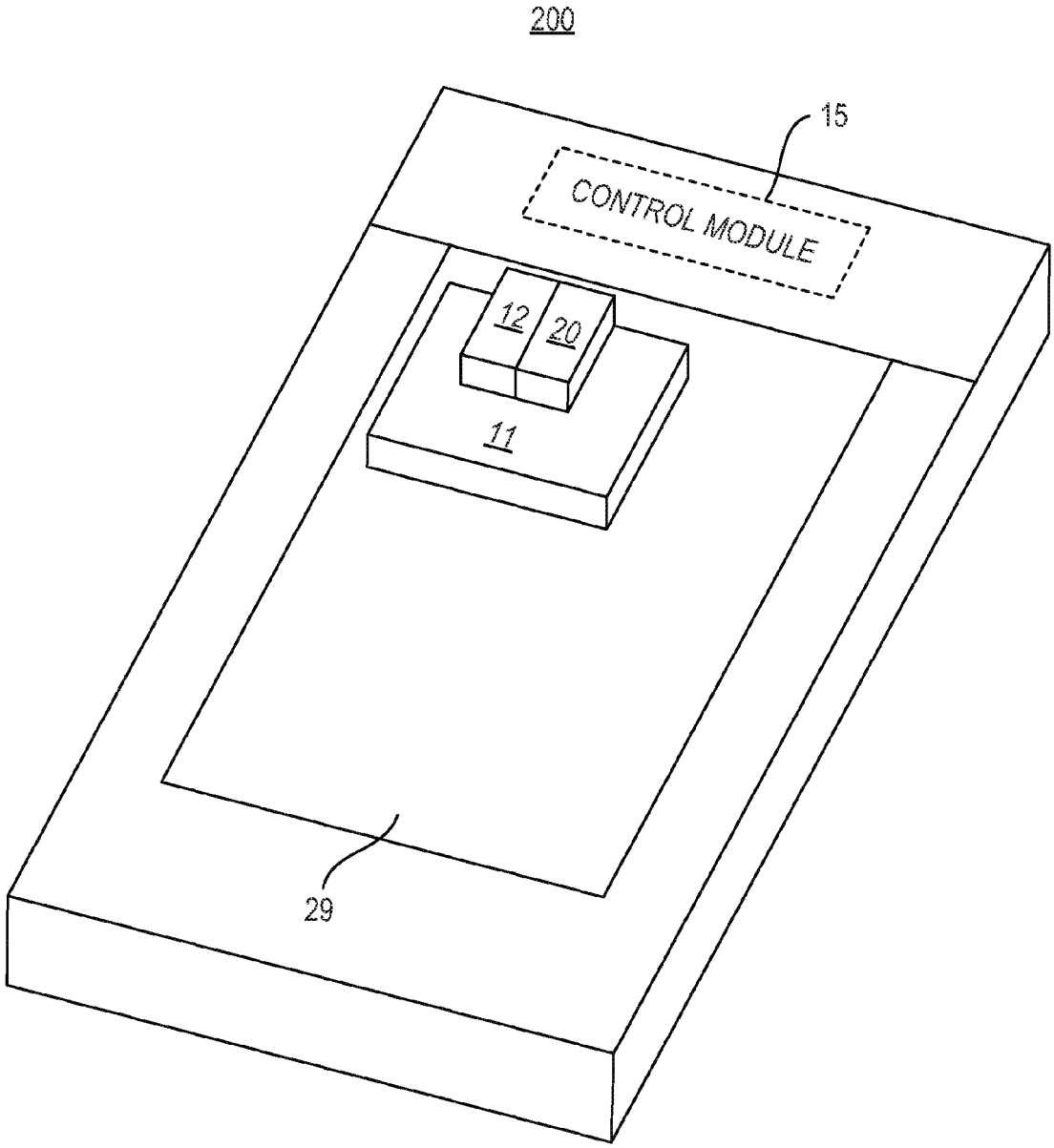
FIG. 2 is a schematic view illustrating a printing system according to an example.
Figure 3:
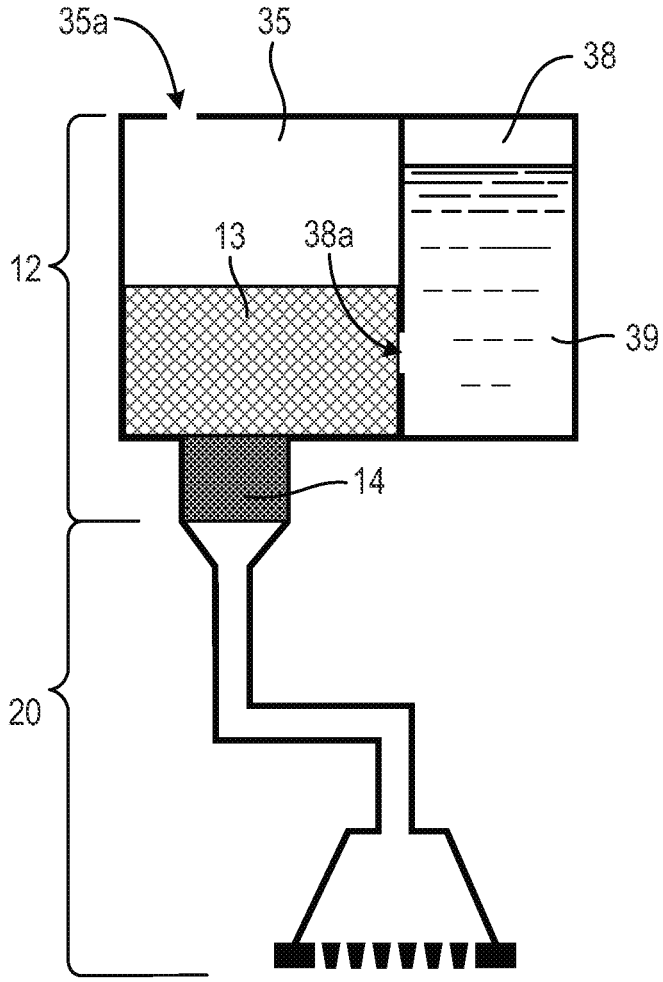
FIG. 3 is a schematic view illustrating a printing fluid delivery system and a printhead of the printing system of FIG. 2 according to an example.

FIG. 2 is a schematic view illustrating a printing system according to an example. FIG. 3 is a schematic view illustrating a printing fluid delivery system and a printhead of the printing system of FIG. 2 according to an example. Referring to FIGS. 2 and 3, in some examples, a printing system 200 includes the carriage 11, the printing fluid delivery system 12, and the control module 15 as previously described with respect to the printing system 100 of FIG. 1. The printing system 200 may also include a printhead 20 to print an image on media 29 in a form of swaths. In some examples, the printing fluid delivery system 12 may include a first region 13, and a second region 14 in fluid communication with the first region 13 as illustrated in FIG. 3. For example, the printing fluid delivery system 12 may include a printing fluid supply. In some examples, the printing fluid delivery system 12 and/or the printhead 20 may be coupled to the carriage 11. The printhead 20, coupled to carriage 11, may move across a print zone to print swaths on media to form an image at a scanning speed.

Referring to FIG. 3, in some examples, the printing fluid delivery system 12 may include a first chamber 35 including the first region 13, a vent 35*a* to place the first chamber 35 in fluid communication with ambient air, a second chamber 38, and a first fluid channel 38*a* disposed between the second chamber 38 and the first region 13. The first fluid channel 38*a* may place the first region 13 and the second chamber 38 in fluid communication with each other. In some examples, the first region 13 may include a first foam member to receive printing fluid 39 from the second chamber 38 and provide the printing fluid to the second region 14. In some examples, the second region 14 may include a second foam member to receive the printing fluid 39 from the first region 13 and provide the printing fluid to the printhead 20. In some examples, each one of the first region 13 and the second region 14 may include a foam member, a chamber, and/or a channel, and the like.

Referring to FIGS. 2 and 3, the control module 15 may identify a sufficient amount of printing fluid for the printhead 20 to print a current swath. For example, the control module 15 may analyze image data to determine the sufficient amount of printing fluid to print the current swath. Subsequently, the control module 15 may determine whether the sufficient amount of printing fluid is equal to or greater than a volume threshold value based on at least a second printing fluid volume capacity of a second region 14. In some examples, the volume threshold value $v_t$ may correspond to Equation 1.

$$v_t = v_2 + r_2 \times t_a, \text{ where,} \qquad \text{Equation 1}$$

$v_2$ corresponds to a second printing fluid volume capacity of a second region;

$r_2$ corresponds to a refill rate of the second region; and $t_a$ corresponds to an amount of time available to refill the second region.

Referring to FIGS. 2 and 3, in some examples, the control module 15 may identify an additional amount of printing fluid to be supplied to the second region 14 during the respective sweep in response to a determination that the sufficient amount of printing fluid is equal to or greater than the volume threshold value based on at least the second printing fluid volume capacity of the second region 14. Additionally, the control module 15 may determine an amount of time to provide the additional amount of printing fluid to the second region 14 during the respective sweep of the printhead 20. The amount of time may be based on at least a refill rate of the second region 14 in response to the determination that the sufficient amount of printing fluid is equal to or greater than the volume threshold value. In some examples, the additional amount of printing fluid may correspond to an amount of printing fluid to fill the second region 14. In some examples, the additional amount of printing fluid may correspond to an amount of printing fluid by which the sufficient amount of printing fluid for the printhead to print the current swath exceeds the volume threshold value.

In some examples, the amount of time to provide the additional amount of printing fluid to the second region 14 during the respective sweep may correspond to a waiting time period $t_w$. That is, the control module 15 may determine and provide a delay period corresponding to the waiting time period $t_w$. Thus, during the waiting time period $t_w$, the additional amount of printing fluid may be provided to the second region 14. In some examples, the control module 15 may provide a delay period greater than the waiting time period $t_w$. In some examples, the waiting time period $t_w$ may be based on at least one of an amount of printing fluid used during the previous swath, a refill rate of the second region 14, and the second printing fluid volume capacity of the second region 14. In some examples, the waiting time period $t_w$ may be the lesser of $t_1$ and $t_2$. That is, $t_1$ may correspond to the greater of $(i_p - r_2 * t_s)/r_2$ and zero. Also, $t_2$ may correspond to $v_2/r_2$. Further, $i_p$ may correspond to an amount of printing fluid used in a previous swath, $r_2$ may correspond to a refill rate of the second region 14, $t_s$ may correspond to an amount of time since the beginning of a last sweep, and $v_2$ may correspond to the second printing fluid volume capacity of the second region 14.

The control module 15 may also provide the amount of time during the respective sweep for the second region 14 to be supplied with the additional amount of printing fluid from the first region 13 in response to the determination that the sufficient amount of printing fluid is equal to or greater than the volume threshold value. In some examples, the control module 15 of the printing system 200 may also provide at least one delay period during the respective sweep to enable the amount of time during the respective sweep for the second region 14 to be supplied with the additional amount of printing fluid from the first region 13. The at least one delay period may include at least one of a pause in scanning of the printhead 20 and a reduction in a scanning speed of the printhead 20 for a respective period of time during a respective sweep.

For example, the control module 15 may provide a plurality of delay periods during the respective sweep to enable the amount of time during the respective sweep for the second region 14 to be supplied with the additional amount of printing fluid from the first region 13. Alternatively, the control module 15 may allow printing of the current swath at a normal print speed in response to a determination that the sufficient amount of printing fluid for the printhead 20 to print the current swath is less than the volume threshold value.

Referring to FIGS. 2 and 3, in some examples, the control module 15 may obtain the refill rate of the second region 14 based on at least a characteristic of the printing fluid delivery system 12. For example, a predetermined refill rate from memory may be identified based on at least the characteristic of the printing fluid delivery system 12 corresponding to a remaining amount of printing fluid supply life. That is, the memory may include a lookup table having a plurality of predetermined refill rates corresponding to various conditions of a respective printing fluid delivery system. A respective condition, for example, may include an amount of remaining printing fluid of the respective printing fluid delivery system.

Figure 4:
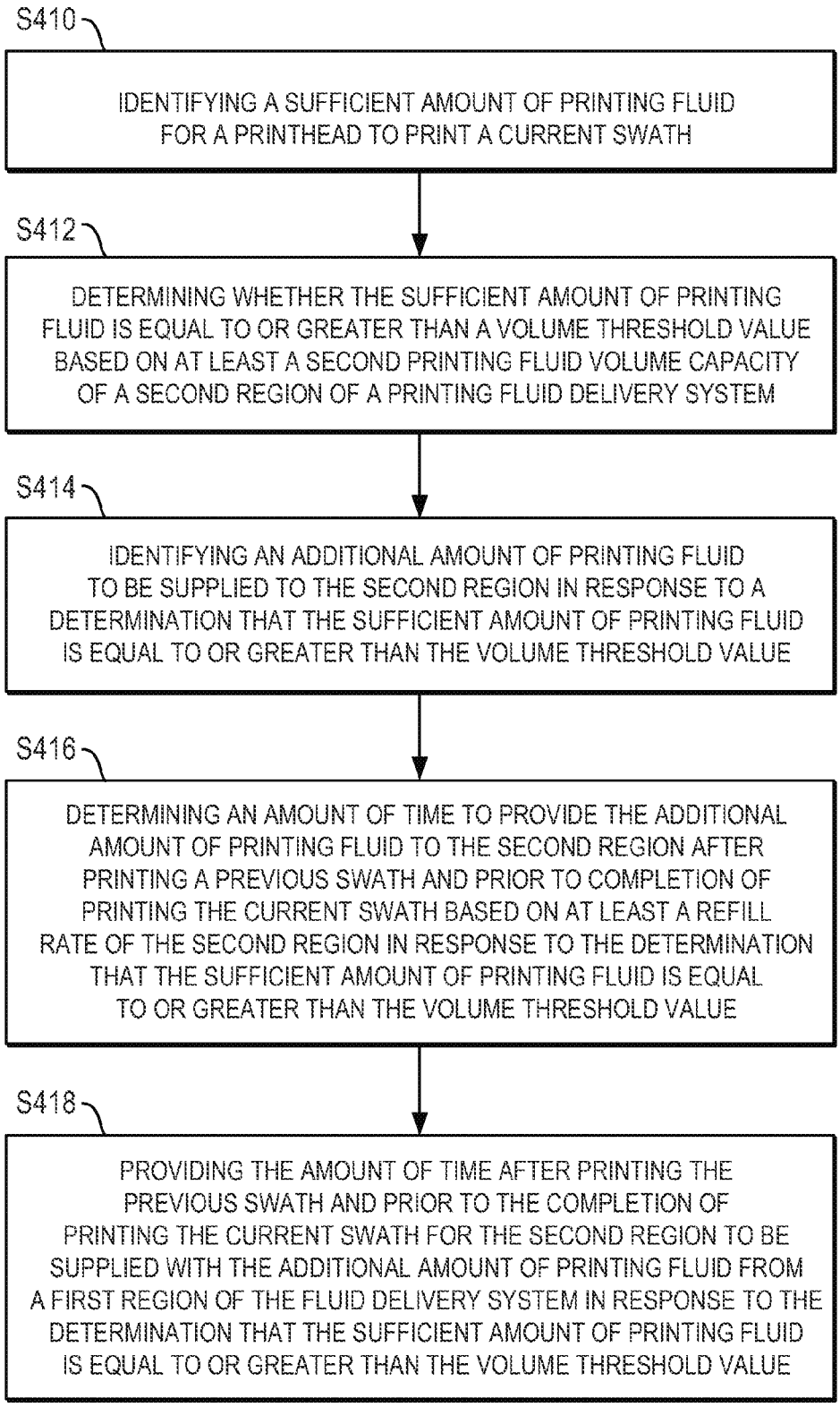
FIG. 4 is a flowchart illustrating a method to control a flow-rate of printing fluid in a printing fluid delivery system according to an example.

FIG. 4 is a flowchart illustrating a method to control a flow-rate of printing fluid in a printing fluid delivery system including a second region to receive the printing fluid from a first region and to provide the printing fluid to a printhead to print a plurality of swaths according to an example. In block S410, a sufficient amount of printing fluid for the printhead to print a current swath is identified. In block S412, whether the sufficient amount of printing fluid is equal to or greater than a volume threshold value based on at least a second printing fluid volume capacity of the second region is determined. In some examples, the volume threshold value $v_t$ may correspond to Equation 1 previously identified.

In block S414, an additional amount of printing fluid to be supplied to the second region is identified in response to a determination that the sufficient amount of printing fluid is equal to or greater than a volume threshold value based on at least a second printing fluid volume capacity of the second region. In some examples, the additional amount of printing fluid may correspond to an amount of printing fluid to fill the second region 14. In some examples, the additional amount of printing fluid may correspond to an amount of printing fluid by which the sufficient amount of printing fluid for the printhead to print the current swath exceeds the volume threshold value.

In block S416, an amount of time to provide the additional amount of printing fluid to the second region after printing a previous swath and prior to completion of printing the current swath based on at least a refill rate of the second region is determined in response to the determination that the sufficient amount of printing fluid is equal to or greater than the volume threshold value. In some examples, the amount of time to provide the additional amount of printing fluid to the second region after printing the previous swath and prior to the completion of printing the current swath is based on the refill rate of the second region, an amount of printing fluid printed in a previous swath, and the second printing fluid volume capacity of the second region.

In block 3418, the amount of time after printing the previous swath and prior to the completion of printing the current swath for the second region to be supplied with the additional amount of printing fluid from the first region is provided in response to the determination that the sufficient amount of printing fluid is equal to or greater than the volume threshold value. For example, at least one delay period may be provided after printing the previous swath and prior to the completion of printing the current swath. The at least one delay period may include at least one of a pause in a scanning of the printhead and a reduction of a scanning speed of the printhead for a respective period of time during a respective sweep.

In some examples, the method may also include providing the additional amount of printing fluid from the first region to the second region during the amount of time. The method may also include obtaining the refill rate of the second region based on at least a characteristic of the printing fluid delivery system. For example, a predetermined refill rate may be obtained from memory based on at least the characteristic of the printing fluid delivery system corresponding to a remaining amount of printing fluid supply life. Alternatively, in response to a determination that the sufficient amount of printing fluid for the printhead to print the current swath is less than the volume threshold value in block S412, printing of the current swath at a normal print speed is allowed.

Figure 5:
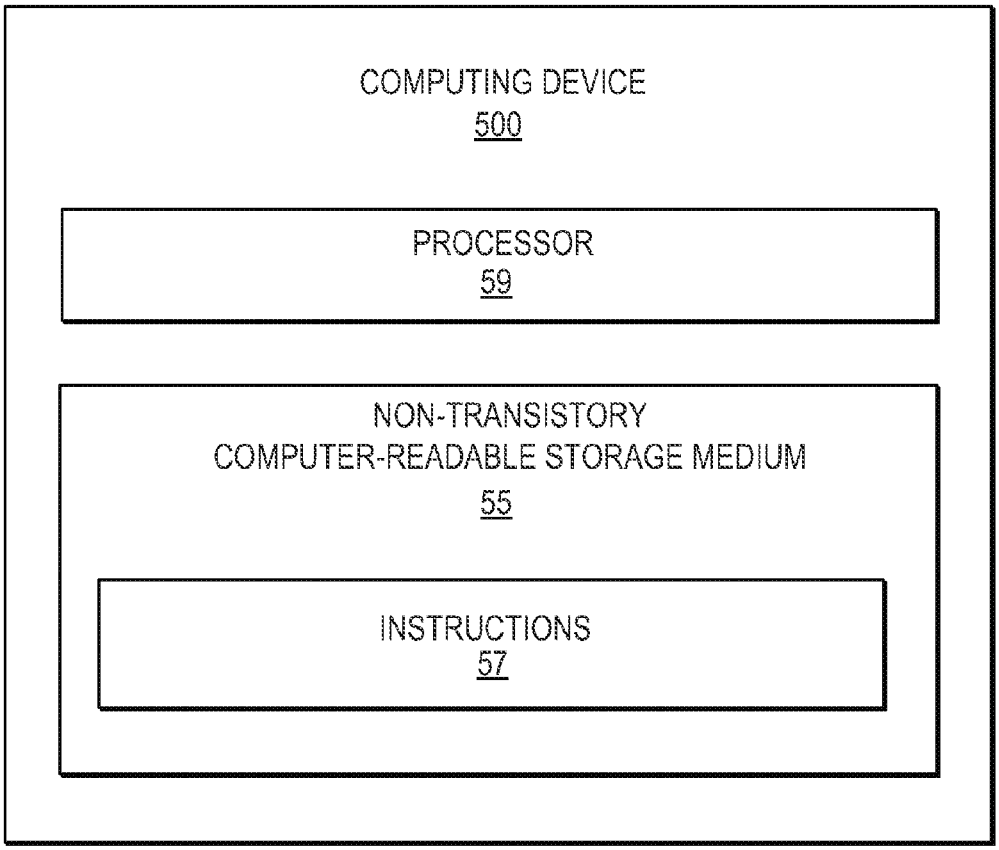
FIG. 5 is a block diagram illustrating a computing device such as a printing system including a processor and a non-transitory, computer-readable storage medium to store instructions to operate the printing system to control a flow-rate of printing fluid in a printing fluid delivery system according to an example.

FIG. 5 is a block diagram illustrating a computing device such as a printing system including a processor and a non-transitory, computer-readable storage medium to store instructions to operate a printing system to control a flow-rate of printing fluid in a printing fluid delivery system according to an example. The printing fluid delivery system may include a second region to receive the printing fluid from a first region and to provide the printing fluid to a printhead to print a plurality of swaths according to an example. Referring to FIG. 5, in some examples, the non-transitory, computer-readable storage medium 55 may be included in a computing device 500 such as the printing system. In some examples, the non-transitory, computer-readable storage medium 55 may be implemented in whole or in part as instructions 57 such as computer-implemented instructions stored in the computing device 500 locally or remotely, for example, in a server or a host computing device considered herein to be part of the printing system.

Referring to FIG. 5, in some examples, the non-transitory, computer-readable storage medium 55 may correspond to a storage device that stores instructions 57, such as computer-implemented instructions and/or programming code, and the like. For example, the non-transitory, computer-readable storage medium 55 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 5, examples of storage devices include, but are not limited to, hard disk drives, compact disc drives, digital versatile disc drives, optical drives, and flash memory devices. In some examples, the non-transitory, computer-readable storage medium 55 may be a suitable medium upon which the instructions 57 are printed, as the instructions 57 can be electronically captured, via, for instance, optical scanning of the paper or other medium, then compiled, interpreted or otherwise processed in a single manner, if necessary, and then stored therein. A processor 59 generally retrieves and executes the instructions 57 stored in the non-transitory, computer-readable storage medium 55, for example, to operate a computing device 500 such as a printing system to control a flow-rate of printing fluid in a printing fluid delivery system. The printing fluid delivery system may include a second region to receive the printing fluid from a first region and to provide the printing fluid to a printhead to print a plurality of swaths in accordance with an example. In an example, the non-transitory, computer-readable storage medium 55 can be accessed by the processor 59.

it is to be understood that the flowchart of FIG. 4 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be rearranged relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method to control a flow-rate of printing fluid in a printing fluid delivery system including a second region to receive the printing fluid from a first region and to provide the printing fluid to a printhead to print a plurality of swaths, the method comprising:

identifying a sufficient amount of printing fluid for the printhead to print a current swath; and determining whether the sufficient amount of printing fluid is equal to or greater than a volume threshold value based on at least a second printing fluid volume capacity of the second region, and if so:

identifying an additional amount of printing fluid to be supplied to the second region;

determining an amount of time to provide the additional amount of printing fluid to the second region after printing a previous swath and prior to completion of printing the current swath based on at least a refill rate of the second region; and providing the amount of time after printing the previous swath and prior to the completion of printing the current swath for the second region to be supplied with the additional amount of printing fluid from the first region.

2. The method of claim 1, further comprising:

providing the additional amount of printing fluid from the first region to the second region during the amount of time.

3. The method of claim 1, further comprising:

obtaining the refill rate of the second region based on at least a characteristic of the printing fluid delivery system.

4. The method of claim 3, wherein the obtaining the refill rate of the second region based on at least a characteristic of the printing fluid delivery system further comprises:

identifying a predetermined refill rate from memory based on at least the characteristic of the printing fluid delivery system corresponding to a remaining amount of printing fluid supply life.

5. The method of claim 1, wherein the amount of time to provide the additional amount of printing fluid to the second region after printing the previous swath and prior to the completion of printing the current swath is based on the refill rate of the second region, an amount of printing fluid printed in a previous swath, and the second printing fluid volume capacity of the second region.

6. The method of claim 1, wherein the providing the amount of time after printing the previous swath and prior to the completion of printing the current swath for the second region to be supplied with the additional amount of printing fluid from the first region further comprises:

providing at least one delay period after printing the previous swath and prior to the completion of printing the current swath.

7. The method of claim 6, wherein the at least one delay period after printing the previous swath and prior to the completion of printing the current swath further comprises:

at least one of a pause in a scanning of the printhead and a reduction of a scanning speed of the printhead for a respective period of time during a respective sweep.

8. The method of claim 1, wherein the volume threshold value $v_t$ corresponds to the following equation:

$$v_t = v_2 + r_2 \times t_a, \text{ where,}$$

$v_2$ corresponds to a second printing fluid volume capacity of a second region;

$r_2$ corresponds to a refill rate of the second region; and $t_a$ corresponds to an amount of time available to refill the second region.

9. The method of claim 1, further comprising:

allowing printing of the current swath at a normal print speed in response to a determination that the sufficient amount of printing fluid for the printhead to print the current swath is less than the volume threshold value.

10. A printing system, comprising:

a carriage to receive a printhead to print an image on media in a form of swaths, the carriage to move the printhead in a form of sweeps such that a respective sweep occurs from completion of printing a previous swath to a completion of printing a current swath;

a printing fluid delivery system including a first region having a first printing fluid volume capacity to store printing fluid and a second region having a second printing fluid volume capacity that is less than the first printing fluid volume capacity to receive the printing fluid from the first region and provide the printing fluid to the printhead; and a control module to identify a sufficient amount of printing fluid for the printhead to print the current swath and determine whether the sufficient amount of printing fluid is equal to or greater than a volume threshold value based on at least a second printing fluid volume capacity of the second region, and if so to identify an additional amount of printing fluid to be supplied to the second region during the respective sweep, determine an amount of time needed to provide the additional amount of printing fluid to the second region during the respective sweep based on at least a refill rate of the second region, and provide the amount of time during the respective sweep for the second region to be supplied with the additional amount of printing fluid from the first region.

11. The printing system of claim 10, wherein the control module is configured to allow printing of the current swath at a normal print speed in response to a determination that the sufficient amount of printing fluid for the printhead to print the current swath is less than the volume threshold value.

12. The printing system of claim 10, wherein the control module is configured to provide at least one delay period during the respective sweep to enable the amount of time during the respective sweep for the second region to be supplied with the additional amount of printing fluid from the first region.

13. The printing system of claim 10, wherein the at least one delay period includes at least one of a pause in a scanning of the printhead and a reduction of a scanning speed of the printhead for a respective period of time during a respective sweep.

14. The printing system of claim 10, wherein the control module is configured to obtain the refill rate of the second region based on at least a characteristic of the printing fluid delivery system by identifying a predetermined refill rate from memory based on at least the characteristic of the printing fluid delivery system corresponding to a remaining amount of printing fluid supply life.

15. A non-transitory computer-readable storage medium having computer executable instructions stored thereon to operate a printing system to control a flow-rate of printing fluid in a printing fluid delivery system including a second region to receive the printing fluid from a first region and to provide the printing fluid to a printhead to print a plurality of swaths, the instructions are executable by a processor to:

identify a sufficient amount of printing fluid for the printhead to print a current swath; and determine whether the sufficient amount of printing fluid is equal to or greater than a volume threshold value based on at least a second printing fluid volume capacity of the second region, and in response to a determination that the sufficient amount of printing fluid is less than the volume threshold value:

allow printing of the current swath at a normal print speed; and in response to a determination that the sufficient amount of printing fluid is equal to or greater than the volume threshold value:

identify an additional amount of printing fluid to be supplied to the second region;

determine an amount of time to provide the additional amount of printing fluid to the second region after printing a previous swath and prior to completion of printing the current swath based on at least a refill rate of the second region; and provide the amount of time after printing the previous swath and prior to the completion of printing the current swath for the second region to be supplied with the additional amount of printing fluid from the first region.

* * * * *